United States Patent [19]

Repass

[11] 4,170,921

[45] Oct. 16, 1979

[54] BRAIDED ROPE

[75] Inventor: George H. Repass, Marion, Mass.

[73] Assignee: New England Ropes, Inc., New Bedford, Mass.

[21] Appl. No.: 888,144

[22] Filed: Mar. 17, 1978

[51] Int. Cl.[2] ..... D04C 1/12

[52] U.S. Cl. ..... 87/6; 87/8

[58] Field of Search ..... 87/5–9

[56] References Cited

U.S. PATENT DOCUMENTS

| | | | |
|---|---|---|---|
| 2,469,178 | 5/1949 | Salvans | 87/6 |
| 3,030,851 | 4/1962 | Meyer | 87/6 |
| 3,035,476 | 5/1962 | Fogden | 87/6 X |
| 3,078,755 | 2/1963 | Chace, Jr. | 87/6 X |
| 3,090,277 | 5/1963 | Schmittmann | 87/8 |
| 3,141,372 | 7/1964 | Benk | 87/6 |
| 3,545,334 | 12/1970 | Dudley | 87/8 |

*Primary Examiner*—John Petrakes

*Attorney, Agent, or Firm*—Salter & Michaelson

[57] ABSTRACT

A braided rope construction comprising a plurality of singles yarns twisted together to form a plurality of plied yarns which are then braided, with the helical angle of twist of the singles yarn within their respective plied yarn being equal and opposite to the helical angle of the plied yarns in the braid, whereby the singles yarns extend substantially parallel to the axis of said rope.

11 Claims, 9 Drawing Figures

BRAIDED ROPE

BACKGROUND AND SUMMARY OF THE INVENTION

The present invention relates generally to a braided rope construction and is more particularly concerned with a novel and improved double braid, i.e. rope or cordage having a braided core with a braided cover formed thereover.

Double braided ropes of this general type are known in the prior art and the braided cord disclosed in Fogden U.S. Pat. No. 3,035,476 issued May 22, 1962 is an example of the type of double braid with which the present invention is concerned, and furthermore represents what is thought to be the closest prior art.

In the Fogden patent, the braided cover is made by braiding a plurality of "singles" yarns in such a manner that the individual fibers or filaments which make up the "singles" yarns extend in a direction substantially parallel to the axis of the rope, which has been found to create less friction when the rope is passed through or chock or is otherwise moved axially while in frictional contact with some other object, thus resulting in less snagging of the individual filaments or fibers, thereby promoting longer rope life. This is accomplished in the Fogden patent by twisting together a plurality of individual fibers or strands to form what is known as a "singles" yarn and then braiding a plurality of said "singles" yarns in such a manner that the direction of twist of the individual fibers and their respective "singles" yarns is equal and opposite to the direction of its respective "singles" yarns in the braid, the result being that the individual fibers or filaments extend substantially parallel to the axis of the rope.

In the double braided rope of Fogden, the individual fibers or filaments which are twisted together to make up a "singles" yarn comprise a large bundle of fibers tightly twisted together. This hard, tight twist of the individual filaments or fibers is required to properly hold the fibers together so as to minimize or prevent snagging, thereby increasing wear life, and also is required in order to assure that the fibers lie parallel to the axis of the rope, so as to minimize friction when the rope is passed through a chock or the like. However, it is important to understand that this hard, tight twist of the individual fibers increases the length of fiber in a given length of braid, thereby increasing the stretch of the rope as load is applied thereto, which is an extremely undesirable characteristic, particularly where the rope is being used for yachting purposes or the like, which is a common usage for double braided ropes of this type. In addition, the hard, tight twist of the individual fibers or filaments minimizes the exposed outer surface of the filaments, i.e. "rounds up" the yarns, thus reducing the bearing surface of the rope and making it harsher to the hands when handled.

It is therefore a primary object of the present invention to provide a braided rope of the general type described in which the individual fibers in the rope lie straighter, i.e. follow a shorter path in the braid, whereby substantially less stretch of the braided rope results from a given load, when compared, for example, to the type of rope shown in the aforesaid Fogden patent.

Another object of my invention is the provision of a braided rope of the character described having a greater outer bearing surface, thus distributing the wear over a larger area, and at the same time, resulting in a smoother surface that is more comfortable when gripped by a person's hands.

A further object is the provision of a rope with the characteristics described wherein the individual fibers or filaments are "locked in" or twisted together in relatively small bundles, thus resulting in less likelihood of snagging, which in turn increases the wear life of the rope.

The above objectives are achieved by twisting together a relatively small bundle of individual fibers or filaments to form a plurality of "singles" yarns and then twisting together a plurality of said "singles" yarns to form a plurality of "plied" yarns. When the "singles" yarns are twisted together to make up the "plied" yarns, the direction of twist is opposite to the direction of twist of the individual fibers or filaments in their respective "singles" yarns. More specifically, if the individual fibers or filaments are twisted in an "S" direction to make up the "singles" yarns, then the "singles" yarns are twisted in a "Z" direction to form the "plied" yarns, and vice versa.

As a result of this, the individual fibers or filaments, as they exist in the braid, lie rather flat or ribbon-like, since relatively little twist remains in the "singles" yarns. The helical angle which the fibers form as they lie in the braid is relatively open or slack, as compared to other braids, such as that shown in the Fogden patent, where the fibers are tightly twisted, as aforesaid. Since, however, the helical angle of twist of the "singles" yarns within their respective plied yarn is equal and opposite to the helical angle at which the plied yarn lies in the braid, it will be seen that the "singles" yarns extend substantially parallel to the axis of the rope, which is a desirable characteristic.

Thus it might be said that the basic difference between the present invention and the aforesaid Fogden patent is that in Fogden "singles" yarns are braided so that the individual fibers or filaments in the "singles" yarns extend substantially parallel to the axis of the rope, whereas in the present invention "singles" yarns are plied or twisted together to form plied yarns, which are then braided, whereby instead of the individual fibers or filaments extending parallel, it is the "singles" yarns which extend parallel to the axis of the rope. The concept of braiding plied yarns instead of "singles" yarns constitutes a completely novel and unique approach in the manufacture of braided ropes of the type under consideration, and has been found to result in amazing advantages, such as less stretch for a given load, less snagging and hence greater wear life, as well as smoother handling.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED FORM OF THE INVENTION

Figure 1:
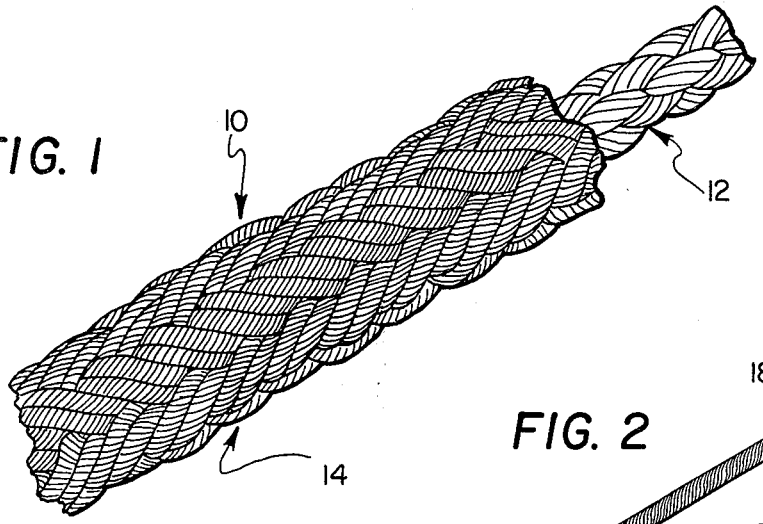
FIG. 1 is a perspective view of a double braided rope constructed in accordance with my invention.
Figure 2:
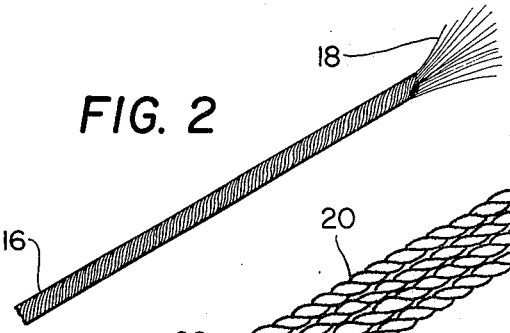
FIG. 2 is a perspective view of a singles yarn that forms a part of the present construction.

Referring now to the drawings, a double braided rope constructed in accordance with the present invention is shown in FIG. 1 generally at 10 comprising a braided core 12 and a braided cover 14.

The core 12 is formed by taking a plurality of singles yarns 16, each of which comprises a plurality of individual fibers or filaments 18 that have been twisted together to form the singles yarn 16. The fibers may be of any desired material, such as nylon, Dacron, polypropylene or the like, it being noted that synthetic fibers of this type are particularly effective for use in braided yachting rope since the rope may be severed by a heated tool whereby the severed ends of the rope fuse, thus eliminating fraying at the cut ends.

Figure 3A:
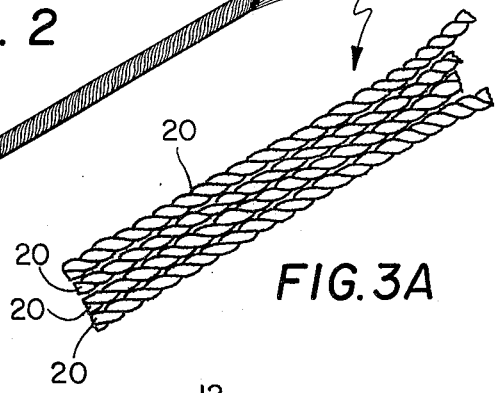
FIG. 3A illustrates four plied yarns longitudinally bundled together in substantially parallel relation to form a strand.
Figure 3:
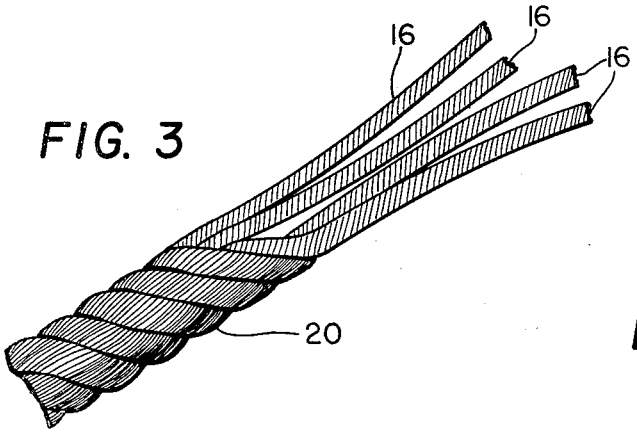
FIG. 3 is a perspective view illustrating a plied yarn formed by the twisting together of four singles yarns.
Figure 4:
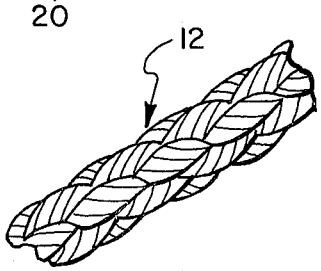
FIG. 4 shows the strands of FIG. 3A braided together to form the rope core.

A plurality of the singles yarns 16 are then twisted or plied together to form a plied yarn 20, as illustrated in FIG. 3, it being noted that the direction in which the singles yarns 16 are twisted together to form the plied yarn is opposite to the direction in which the fibers 18 have been twisted to form the singles yarn 16. Although FIG. 3 shows four singles yarns 16 twisted together to form the plied yarn 20, it will be understood that the plied yarn 20 can comprise any desired number of singles yarns. A plurality of plied yarns 20 of like twist are then longitudinally bundled together in substantially parallel disposition, as illustrated in FIG. 3A to form a strand 22 and here again, although four plied yarns 20 are shown in FIG. 3A as comprising the strand 22, it will be understood that the strand 22 can comprise any desired number of the plied yarns 20. The strands 22 are then braided together by conventional braiding apparatus, using a diamond pattern, to form the completed braided core 12. During the braiding operation, the plied yarns which are twisted in an "S" direction extend in a "Z" direction in the braid, and vice versa.

By way of example, where a one-half inch diameter rope is being made with a braided plied yarn core 12, three ends of one thousand denier polyester fiber are twisted at thirty-six turns per foot in an "S" direction to make the singles yarns 16. Four of the singles yarns are then twisted together in a "Z" direction at twenty-seven turns per foot to form the plied yarns 20. The strands 22 are then braided at one and one-half picks per inch to form the core 12, it again being emphasized that the strand comprising "Z" twisted plied yarns extend in an "S" direction in the braid and vice versa.

Figure 6:
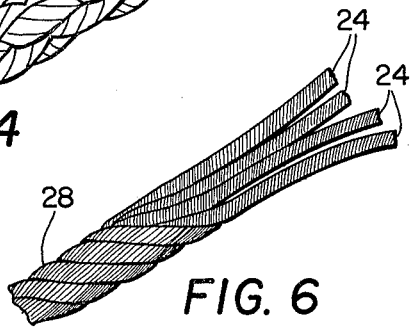
FIG. 6 illustrates four of the singles yarns of FIG. 5 twisted together to form a plied yarn.
Figure 5:
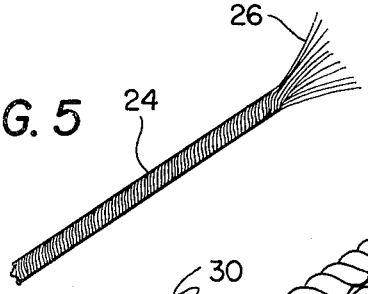
FIG. 5 illustrates a singles yarn used in making the rope outer cover.
Figure 7:
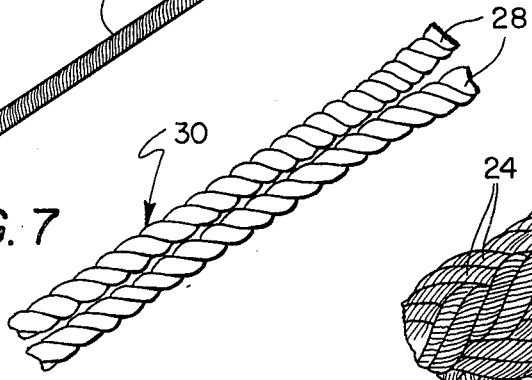
FIG. 7 shows two of the plied yarns of FIG. 6 longitudinally bundled together in substantially parallel disposition to form a strand.
Figure 8:
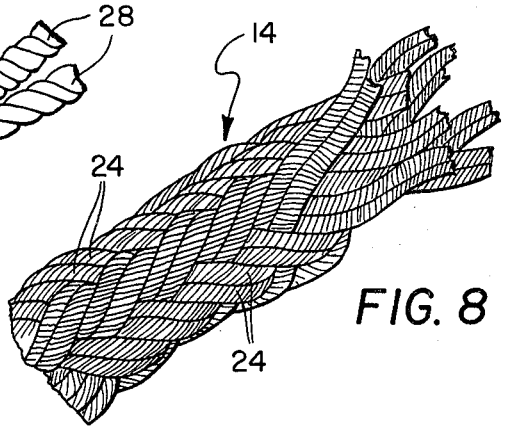
FIG. 8 shows a braided outer cover formed by braiding the strands of FIG. 7.

The braided cover 14 is also formed by taking a plurality of singles yarns 24, each of which is made up of a plurality of twisted fibers or filaments 26, four of said singles yarns 24 then being twisted together to form plied yarn 28, as illustrated in FIG. 6. Once again, the direction in which the singles yarns 24 are twisted together to form plied yarn 28 is opposite to the direction of twist of the fibers 26. Two of the plied yarns 28 are then longitudinally bundled together in substantially parallel disposition, as illustrated in FIG. 7, to form a strand 30, which strands are then braided together by conventional braiding apparatus, using a twill weave type of braid, to form the braided cover 14. Once again, the direction in which the singles yarns 24 have been twisted together to form the plied yarn is opposite to the direction in which the strands 30 extend when braided, and specifically the helical angles of twist are not only opposite but also substantially equal, whereby in the final braided cover, the singles yarns 24 extend substantially parallel to the axis of the rope, as illustrated most clearly in FIG. 8.

One example of braided cover 14 would be to take three ends of one thousand denier polyester fiber and twist them together at thirty-six turns per foot in an "S" direction to form the singles yarns 24. Four such singles yarns are then twisted together at twenty-seven turns per foot in a "Z" direction to form the plied yarn 28. Two such plied yarns are then wound parallel on a braider package to form strand 30, after which sixteen strands, eight with "S" twisted plied yarns and eight with "Z" twisted plied yarns are braided together at 4.1 picks per inch over the core 12, the strands with "S" twisted plied yarns following the "Z" braiding helix and vice versa, thereby leaving the singles yarns essentially parallel to the rope axis.

Although the precise pick ratio at which the core 12 and cover 14 are braided is not critical, preferably the pick ratio of the cover is greater than 4, whereby the individual fibers 26 in the braid lie rather flat in somewhat ribbon-like form, since relatively little twist remains in the singles yarns 24. The helical angle which the fibers form as they lie in the braid is relatively open or slack, as compared to other braided covers, such as that of the Fogden patent, where the fibers are twisted very tightly in large bundles to form the yarns. As previously stated, since the fibers 26 lie straighter, they follow a shorter path in the braid, whereby load on the rope 10 is absorbed faster with substantially reduced stretch. Since the braided strands are made of plied yarns rather than singles yarns, snagging is minimized, while at the same time the fact that the singles yarns extend substantially parallel to the axis of the rope reduces friction and abrasion when the rope is drawn through a chock or the like. The relatively flat, loose disposition of the individual fibers results in a rope surface that is smoother and easier on the hands.

Although the braided core 12 has been illustrated and described as being made up of strands comprising plied yarns, it should be understood that the core could be made up of braided strands of singles yarns. It is critical, however, that the cover 14 be made from plied yarns, this being the essence of the present invention. Also, it is once again emphasized that the number of singles yarns that are twisted together to make up the plied yarns is not critical, nor is there any criticality to the number of plied yarns that are bundled together longitudinally to form the strands 22 and 30.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A braided rope construction having a cover comprising a plurality of singles yarns formed from a plurality of filaments twisted together, said singles yarns twisted together to form a plurality of separate plied yarns, a plurality of said plied yarns longitudinally bundled together in substantially parallel, non-twist relation to form a strand, a plurality of said strands being braided together with each of the singles yarns therein being disposed at a helical angle that is equal and opposite to the helical angle of said plied yarns in said braid, whereby said singles yarns extend substantially parallel to the axis of said rope.

2. The rope of claim 1 further characterized in that the direction of twist of the filaments in said singles yarns is opposite to the direction in which said singles yarns are twisted to make up said plied yarns.

3. The rope of claim 1 further characterized in that said rope comprises a longitudinally extending core positioned within said braid.

4. The rope of claim 3 further characterized in that said core is a braid.

5. The rope of claim 4 further characterized in that said braided core comprises braided singles yarns.

6. The rope of claim 4 further characterized in that said braided core comprises braided plied yarns.

7. The method of making a braided rope construction comprising the following steps:

(a) twisting together a plurality of individual filiaments to form a plurality of singles yarns;

(b) twisting together a plurality of said singles yarns to form a plurality of plied yarns;

(c) laying a plurality of said plied yarns together in substantially parallel, non-twist relation to form strands; and (d) braiding said strands together so that the helical angle of said plied yarns in said braid is equal and opposite to the helical angle of said singles yarns in their respective plied yarns, whereby said singles yarns extend substantially parallel to the axis of said rope.

8. The method of claim 7 further characterized in that the direction of twist in step (a) is opposite to the direction of twist in step (b).

9. The method of claim 7 further characterized in that the braiding operation of step (c) is performed at a pick ratio of greater than 4 so as to form a relatively loose braid.

10. The method of claim 7 further comprising the step of forming an elongated core, and positioning said core so that the braid of step (c) is formed thereover.

11. The method of claim 10 further comprising the step of braiding said core.

* * * * *